United States Patent [19]

Tanabe et al.

[11] Patent Number: 4,512,077

[45] Date of Patent: Apr. 23, 1985

[54] ELECTRIC SHAVER HAVING IMPROVED SHAVING CHARACTERISTICS

[75] Inventors: Toshio Tanabe; Masakazu Kita, both of Hikone, Japan

[73] Assignee: Matsushita Electric Works, Ltd., Osaka, Japan

[21] Appl. No.: 460,052

[22] Filed: Jan. 21, 1983

[30] Foreign Application Priority Data

Jan. 26, 1982 [JP] Japan ..... 57-10779

[51] Int. Cl.[3] ..... B26B 19/06; B26B 19/38

[52] U.S. Cl. ..... 30/43; 30/41; 30/77; 30/84

[58] Field of Search ..... 30/32, 41.5, 41, 43.92, 30/43.91, 43, 84, 77

[56] References Cited

U.S. PATENT DOCUMENTS

| | | | |
|---|---|---|---|
| 2,170,215 | 8/1939 | Rand | 30/43 |
| 2,190,481 | 2/1940 | Nyhagen | 30/43 |
| 2,194,465 | 3/1940 | Bott | 30/77 X |
| 2,229,959 | 1/1941 | Dalkowitz | 30/43 |
| 2,325,794 | 8/1943 | O'Mealey | 30/84 X |
| 2,545,533 | 3/1951 | Stewart | 30/84 X |
| 2,611,177 | 9/1952 | Halterman | 30/43 |
| 2,617,183 | 11/1952 | Halterman | 30/43 X |
| 3,369,294 | 2/1968 | Shaw | 30/41.5 |
| 4,031,617 | 6/1977 | Tanaka et al. | 30/34.1 |

FOREIGN PATENT DOCUMENTS

| | | | |
|---|---|---|---|
| 905756 | 4/1945 | France | 30/43 |

*Primary Examiner*—Jimmy C. Peters

*Attorney, Agent, or Firm*—Stevens, Davis, Miller & Mosher

[57] ABSTRACT

An electric shaver comprising a housing, a shaving head projecting from an upper end of the housing, a shaving blade having a front shaving edge extending laterally along a front end of the head, a comb having a number of combing teeth arranged laterally side by side and positioned below the front shaving edge of the shaving blade, and an edge cover provided above the shaving blade for abutting against skin when the shaver is in use to regulate, together with the comb, an angle which the edge of the shaving blade makes with respect to the skin. A front edge of the edge cover, the front shaving edge of the shaving blade, and a front end of the comb are aligned substantially on a straight line in a plane perpendicularly cutting the front end of the edge cover, the front shaving edge of the shaving blade and the front end of the comb. In a modified embodiment, the front shaving edge of the shaving blade is located below and slightly offset from a straight line connecting the front edge of the edge cover and front edge of the comb.

12 Claims, 18 Drawing Figures

(a)

(b)

(c)

ELECTRIC SHAVER HAVING IMPROVED SHAVING CHARACTERISTICS

BACKGROUND OF THE INVENTION

This invention relates to an electric shaver and, more particularly, to an electric shaver which is used mainly by females for removing unwanted hair and which comprises a fixed blade having a comb-shaped edge fixed to a head projecting from an upper end of a housing, and a movable blade movable in reciprocation and slidably in contact at its edge with the fixed blade.

Generally, two type of electric shavers have been proposed for removing unwanted body hair. The first is the so-called rotary edge type in which inner edges of a cutting mechanism rotate inside outer edges of the cutting mechanism and the second is the so-called reciprocating edge type in which inner edges of a cutting mechanism reciprocate inside the outer edges of the cutting mechanism. Shavers of these two types have the ability of shaving undesired body hair to a short length; however, an undesirable characteristic of these shavers is that the shaved skin may become irritated, or the shaver edges may not catch hairs which lay down along the skin. Another type of shaver which is known is the so-called trimmer shaver which has moveable edges formed as combed-shaped teeth which slide in contact with a fixed blade having like combed-shaped teeth. This shaver eliminates many of the above described problems associated with rotary edge and reciprocating edge shavers, but it cannot shave hair to the same short length which rotary and reciprocating type shavers can. Accordingly, the trimmer type shaver is only used for rough shaving and is not normally used where fine shaving is desired.

SUMMARY OF THE INVENTION

The present invention has been designed as an improvement on a trimmer-type electric shaver and has as its main object the provision of a trimmer type electric shaver which is capable of cutting long hair by both a rough shaving and also by a fine finishing shaving to thereby provide a very close shave. Another object of the invention is to provide a trimmer type shaver which can be used with shaving soap or foam to provide an improved cutting operation and also which can be used in a dry condition without soap or shaving foam. Yet another object of the invention is the provision of a trimmer-type electric shaver which more easily raises hair from the surface of body skin to assure that it is cut and thereby minimize the problem of any unshaven hair remaining after a shaving operation. Yet another object of the invention is the provision of a trimmer-type shaver which has a soft touch to the skin and which does not hurt or irritate the skin during use. Yet another object of the invention is the provision of a trimmer-type shaver which is easily moved along the skin.

An electric shaver of the invention which achieves these objectives and advantages comprises: a housing; a shaving head projecting from an upper end of the housing; a shaving blade having a front shaving edge extending laterally along a front end of the head, the front edge of said shaving blade projecting from the front end of said head, the shaving blade comprising a fixed blade which has at a front end thereof a comb-shaped edge comprising a number of small teeth arranged laterally side by side and which is fixed in a predetermined position at the head, and a movable blade which has a comb-shaped edge in slidable contact with the comb-shaped edge of the fixed blade and which is movable in reciprocation laterally of the head; a comb having a number of combing teeth arranged laterally side by side and positioned below the front shaving edge of the shaving blade; and an edge cover provided above the shaving blade for abutting against skin when the shaver is in use to regulate, together with the comb, an angle which the edge of the shaving blade makes with respect to the skin; a front edge of the edge cover, and a front end of the comb being aligned on a straight line in a side view plane which is perpendicular to the front end of the edge cover, the front shaving edge of the shaving blade and the front end of the comb. In one preferred embodiment the shaving edge of the shaving blade is substantially aligned on this straight line, while in another preferred embodiment it is below and slightly offset therefrom. The comb may be formed separately from the fixed blade or may form an integral extension thereof.

The above described objects, advantages and structures of the invention and others will be more readily perceived from the following detailed description which is provided in connection with the accompanying drawings.

DETAILED DESCRIPTION OF THE INVENTION

Two embodiments of the invention will be described in connection with the accompanying drawings. The first is shown in FIGS. 1–12 and the second in FIGS. 13–16.

In a first embodiment, the electric shaver of the invention comprises a fixed blade 3*a* having an edge (FIG. 7) which has tips disposed laterally along and projecting from the front end of a shaver head 2 which in turn projects from the upper end of a housing 1. The edge of the blade 3*a* has comb-shape formed by a number of smaller teeth 4 disposed laterally side by side along the length of blade 3*a*. The blade 3*a* is fixed in position at the head 2.

Figure 7:
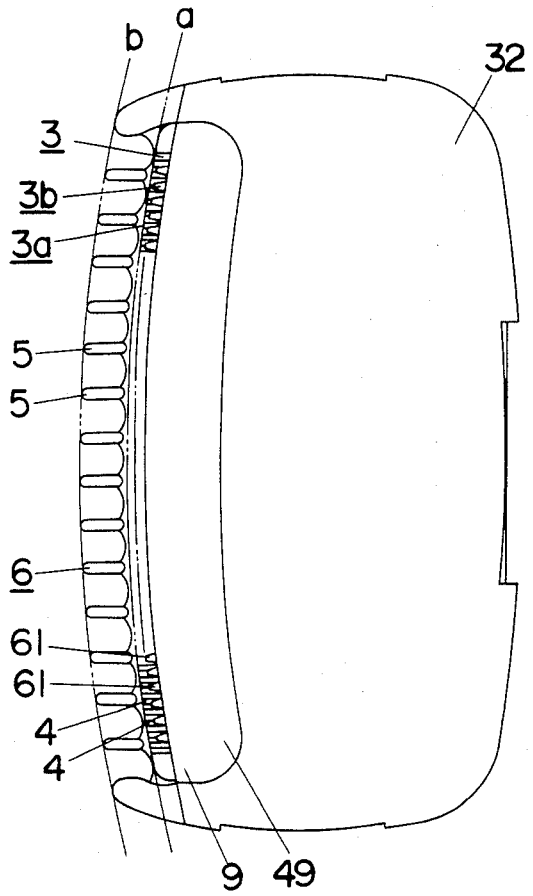
FIG. 7 is a plan view of a head of the same.

A movable blade 3*b* is also provided which has a comb-shaped edge and which is slidable and in contact with the edge of fixed blade 3*a*. Blade 3*b* reciprocates laterally of the head 2. The shaver also has a comb 6 having a number of combing teeth 5 arranged laterally side by side, with comb 6 projecting from the front end of head 2 and below the edge of shaving blade 3 comprising a fixed blade and a movable blade and the foremost end of an edge cover 9 (FIG. 7). Edge cover 9 contacts the skin 8 (FIG. 10) when the edge of shaving blade 3 is cutting hairs 7 and serves to regulate, together with comb 6, the angle the edge of blade 3 makes when in contact with skin 8.

Figure 10:
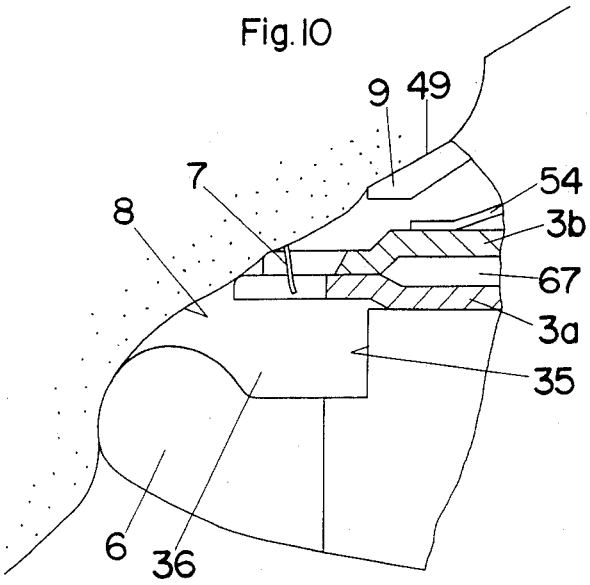
FIGS. 10 and 11 are partial sectional views of the head during use.
Figure 11:
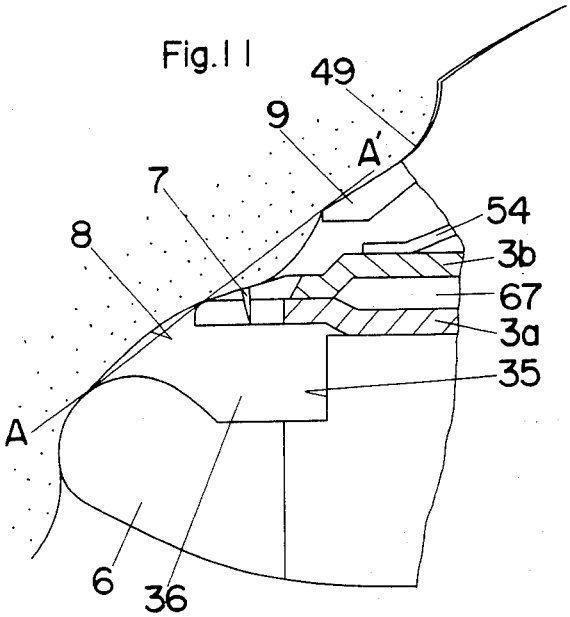

A front end of said edge cover, the edge a of shaving blade 3, and the utmost end b of comb 6 are arranged substantially on the same straight line A—A' (FIG. 11) in a side view plane which cuts and is perpendicular to the edge a of shaving blade 3, the front end of edge cover 9 and the front end of comb 6; that is, in the plane of the sheet containing FIGS. 10 and 11.

Figure 1:
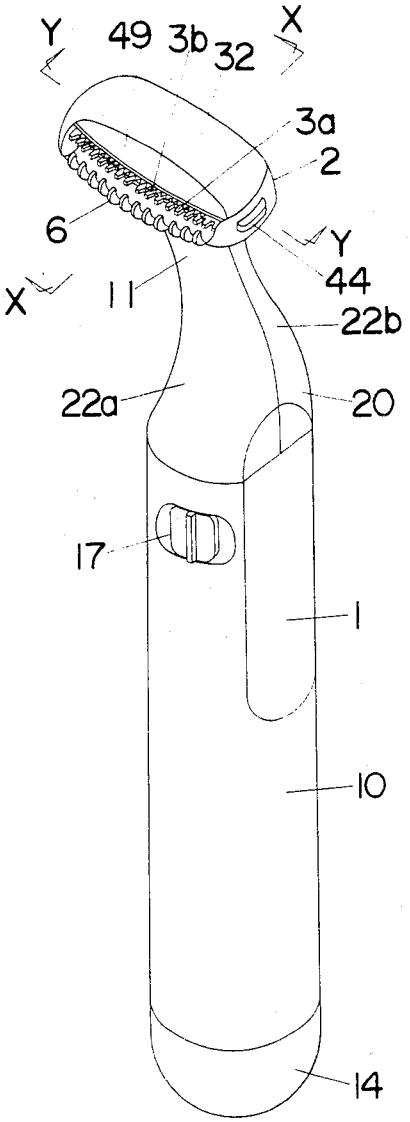
FIG. 1 is a perspective view of an embodiment of the invention.

As noted, a principle feature of the invention is the provision of a shaver which is usable both for so-called wet shaving using soap or shaving foam and so-called dry shaving wherein no soap or shaving foam is used. To this end, the shaver of the invention has a washable head 2 which has a water-proof construction. A housing 1 is provided which is made from synthetic resin and comprises a case body 10 formed as a vertically elongated cylinder and a connecting housing 20 connected to the case body 10, as shown in FIG. 1. The connecting housing 20 is formed to connect at its neck 11 with the case body 10 and support the head 2 so that it is laterally elongated, the head 2 holding the shaving blade 3 comprising the fixed blade 3*a* and movable blade 3*b*.

Figure 2:
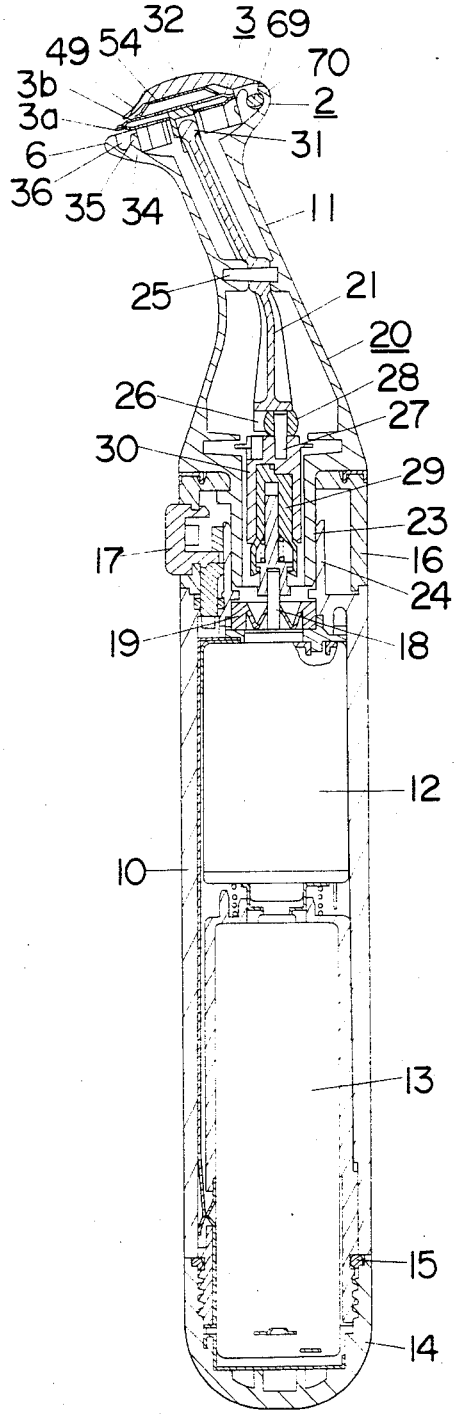
FIG. 2 is a sectional view taken on the line X—X in FIG. 1.

The case body 10, as shown in FIG. 2, encases a motor 12 and a battery 13 is disposed vertically in series, and provides at the lower end a cell cover 14 which provides a water-tight closing of the lower end of housing 1. An O-ring 15 is provided between cover 14 and the bottom of housing 1 to provide a water-tight seal. A tubular spacer 16 (FIG. 2) is mounted between the upper end of case body 10 and the lower end of neck 11 and is provided with a switch handle 17, which is exposed in part outwardly from the spacer 16 and which is operable to switch the power from the battery 13 to the motor 12 to thereby control its on/off operation.

Motor 12 has at the base of an output shaft 18 thereof a waterproof panel 19 through which the upper portion of case body 10 is water tightly sealed so that the battery cover 14 and waterproof panel 19 prevent the entrance of water into the case body 10.

Figure 4:
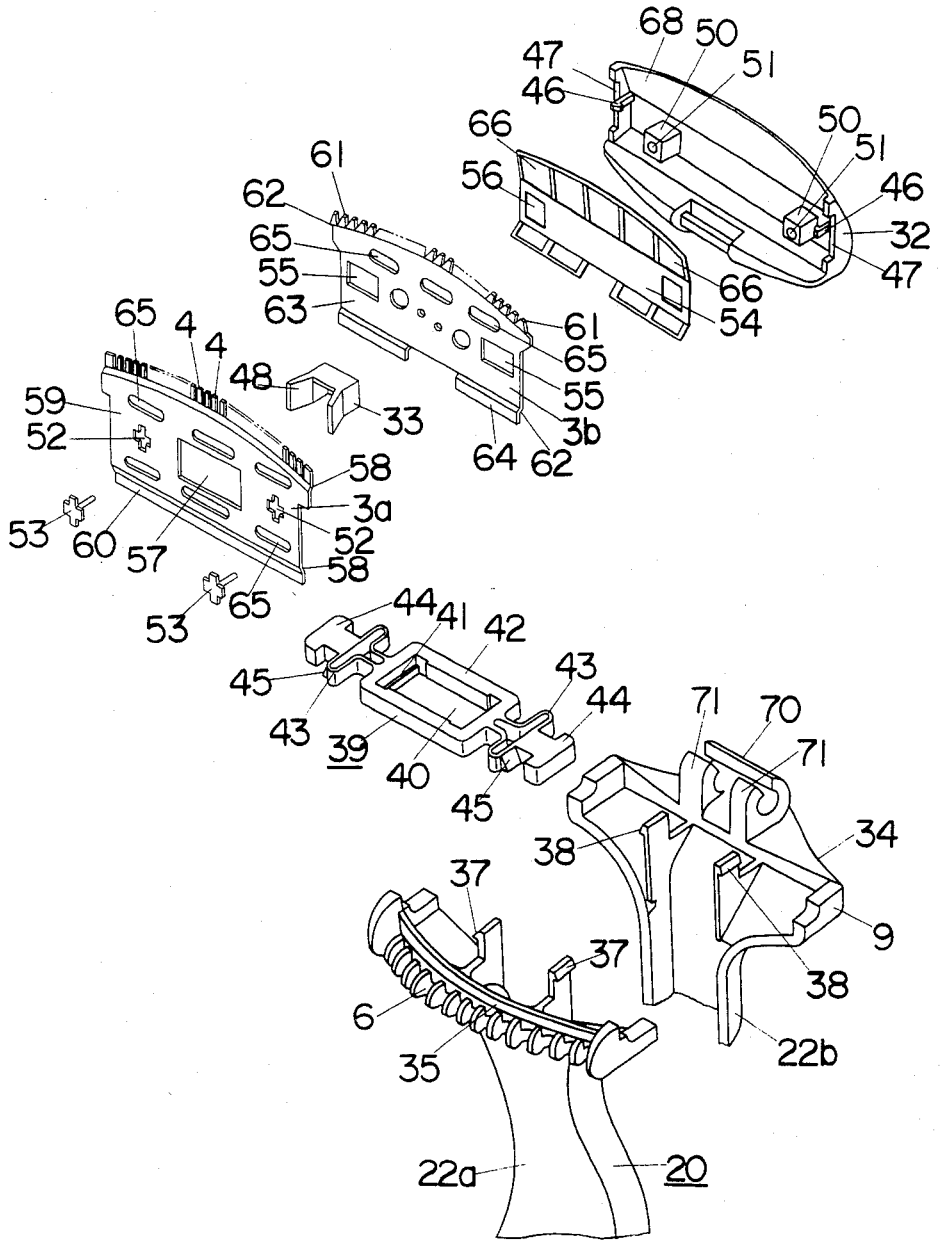
FIG. 4 is a perspective exploded view of the parts shown in the FIG. 1 embodiment.

The connecting housing 20, as most clearly shown in FIG. 4, comprises half-cut bodies 22*a* and 22*b* divided forwardly and rearwardly and incorporate between them a driving lever 21 in the housing 20. Housing 20 forms the neck 11 at the lower portion of and as a part of head 2, the neck 11 extending from the lower end of head 2 to form a connecting cylinder 23 (FIG. 2) which is fit into a socket 24 provided at the uppermost portion of case body 10. In this manner, the neck 11 is connected detachably to the case body 10 through the connecting cylinder 23. The driving lever 21 is inserted into the neck 11 along the length thereof and is pivoted at its intermediate portion to the neck 11 through a pivot pin 25 (FIG. 2) which extends forwardly and backwardly of neck 11 at a substantially lengthwise center of the driving lever 21.

A groove 26 extending to forward portion and rearward portion of neck 11 is provided at the lower end portion of driving lever 21. Groove 26 receives a roller 28 which is fitted rotatably onto an eccentric shaft 27 connected to the output shaft 18 of motor 12. A joint shaft 29 is mounted to motor 12 and is telescopic and biased in the direction of extension by a spring a full stop. The rotation of the joint shaft 29 is transmitted to the shaft base 30, which can be detached from the joint shaft 29 and cause the eccentric shaft 27 to revolve. The eccentric shaft 27 moves in a circle around the axis of output shaft 18 and the roller 28 which is fit onto the eccentric shaft 27 rolls within the groove 26 thereby converting rotation of eccentric shaft 27 into the lateral reciprocation of driving shaft 21. The reciprocation of the lower portion of driving shaft 21 is transmitted as a reciprocation motion to the upper end thereof through pivot 25. A ball member is formed at the upper end of driving shaft 21 and is fit into a connecting socket 33 for the movable blade 3*b* which is carried by a blade holder 32.

Figure 3:
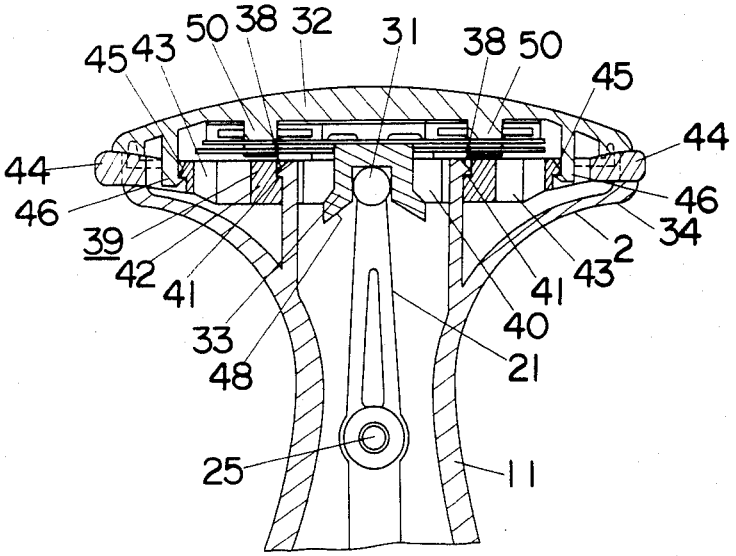
FIG. 3 is a sectional view taken on the line Y—Y in FIG. 1.

The head 2, as shown in FIG. 3, comprises a blade support 34 formed at the upper end of connecting housing 20 and the blade holder 32 for the shaving blade 3, the blade holder being pivoted to the blade support 34. Blade support 34 is formed in a laterally elongated and flat shape when viewed from the front of the shaver. A comb 6 projects from the front end of blade support 34 and comprises a number of combing teeth 5 each of which is vertically flat and elongated when viewed from the front. Combing teeth 5 are disposed laterally side by side. Comb 6 is shaped at the utmost end in a circular arc so that it may smoothly touch with a user's skin.

Comb 6 also allows for a smooth vertical movement of the shaver along human skin and prevents it from laterally sliding. A partition 35 projects vertically from the rear portion of the junction of comb 6 and blade support 34 and extends throughout approximately the entire overall lateral length of the front end of blade support 34. A flue sink 36 is formed between the comb 6 and partition 35 for preventing shaved hairs, hereinafter termed flue, or soap from entering to any great degree into the head 2 when the shaver is used. As a result, flue or soap is less likely to become stuck to driving lever 21 thereby reducing the load which is applied thereto and reducing required cleaning of the entire head 2.

Turning to FIG. 4, the front half-cut member 22*a* of the members 22*a* and 22*b* which form the connecting housing 20, is provided at its rear side with a pair of right-hand and left-hand engaging hooks 37, while the rear half-cut member 22*b*, is provided at its front side with a pair of right-hand and left-hand engaging hooks 38. The engaging hooks 37 and 38 are connected with each other during assembly of the shaver and engage with engaging shoulders 41 at the inner periphery of a rectangular engaging bore 40 provided at the center of a connecting frame 39, thereby fixedly connecting both half-cut members 22*a* and 22*b*. The connecting frame 39 is formed of synthetic resin and has lateral symmetry and the engaging bore 40 is formed at a main body 42 at its central portion. The frame main body 42 has frame mounting or dismounting buttons 44 which are integral with body 42 through thin leaf springs 43 respectively.

Figure 5:
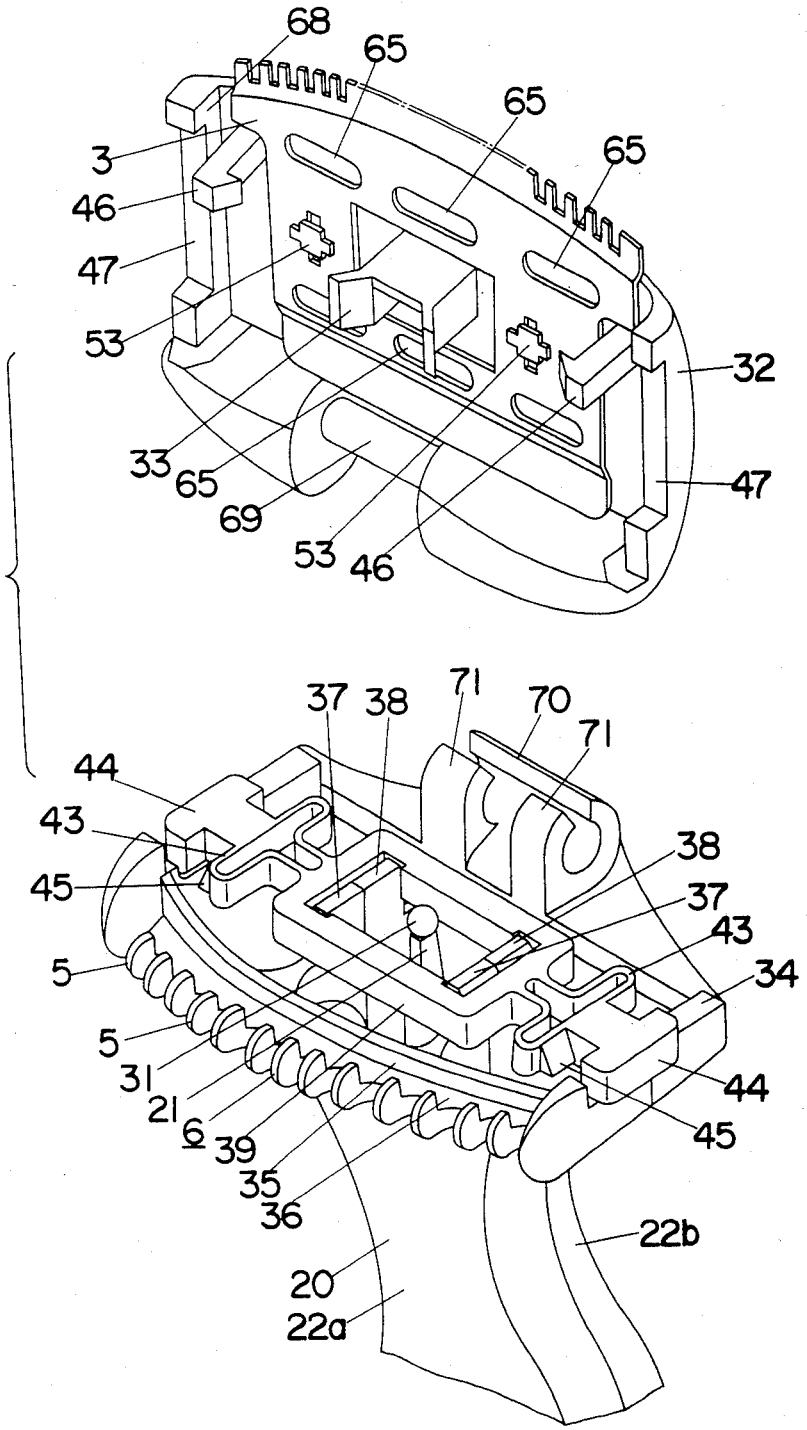
FIG. 5 is a perspective partially exploded view of the same.

The leaf springs 43 each project to forward portion and rearward portion of housing 20 in a U-like shape to provide a spring force acting lengthwise on frame 39. An engaging projection 45 is provided at the outside and extends forward of each leaf spring 43 and engages with a respective connecting hook 46 projecting from the lower surface of blade holder 32, as shown in FIG. 5, thereby fixing the blade holder 32 to the blade support 34 by means of the elasticity of the leaf springs 43. In addition, the blade holder 32 is provided at both lateral sides with cutouts 47 positioned to correspond to the buttons 44 respectively so that the buttons 44 project from the lateral sides of head 2 when the connecting frame 39 is mounted to the head 2. Blade holder 32 can be opened to permit cleaning of the blades by pushing on the frame mounting or dismounting buttons 44 which causes the engaging projections 45 to shift to disengage from the connecting hooks 46, respectively, allowing the blade holder 32 to open.

Figure 6:
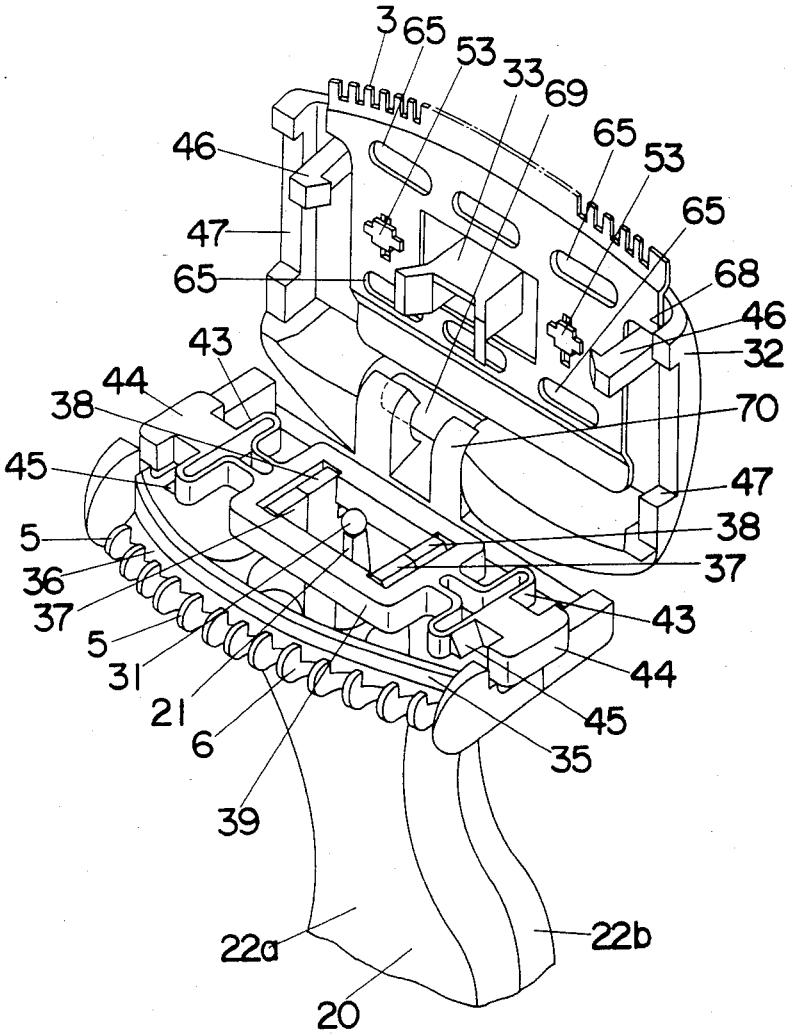
FIG. 6 is a perspective view in part of the FIG. 1 embodiment.

Blade holder 32, as shown in FIGS. 5 through 7, is substantially convex at its upper surface, thereby making it possible to contact smoothly with difficult skin surfaces such as rough and wrinkled skin at an underarm. The blade edge cover 9 projects from the front end of blade holder 32 throughout an overall longitudinal length thereof and is provided at its upper surface with a recess 49 recessed in a plane which is perpendicular to the front end of cover 9 and facing the utmost end thereof. Recess 49 allows the shaver to smoothly move along a user's skin. A pair of right-hand and left-hand fixing posts 50 (FIG. 4) are provided at the lower surface of blade holder 32 and have at their lower end surfaces respective supporting bores 51. The fixed blade 3*a* is fixed to the blade holder 32 by use of fixing pins 53 which are inserted into the supporting bores 51 through cross-shaped fixing bores 52 provided at the fixed blade 3*a* respectively.

Movable blade 3*b* is provided between the lower surface of blade holder 32 and the fixed blade 3*a*, while an urging spring 54 (FIG. 4) is provided between the lower surface of blade holder 32 and the movable blade 3*b*.

The movable blade 3*b*, as shown in FIG. 4, is provided at the positions corresponding to the fixing posts 50 with movable bores 55, each of which is larger in lateral width than each fixing post 50, thereby allowing blade 3*b* to be moved laterally to the extent permitted by the movable bores 55. Urging spring 54 is provided at positions corresponding to the fixing post 50 with through bores 56 to thereby be fitted onto the fixing posts 50 through the bores 56, so that the movable blade 3*b* is press-contacted with the fixed blade 3*a* by means of the elasticity of spring 54.

The connecting socket 33 (FIG. 3) is fixed to the center of movable blade 3*b* and opens at its lower surface to encase the ball member 31 of the driving lever 21 as described above. A guide 48 which is widened laterally and downwardly is formed at the lower end of connecting socket 33 so that the ball member 31 may be easily received therein. At the center of fixed blade 3*a* is formed a laterally elongated throughbore 57 into which the connecting socket 33, which is fixed to the movable blade 3*b*, is inserted, the connecting socket 33 being moved laterally within the throughbore 57.

The fixed blade 3*a* is provided at its front end with a comb-shaped edge comprising a number of small rectangular teeth 4 projecting outwardly thereof and arranged laterally side by side. Fixed blade 3*a* also has at the front and rear ends stepped portions 58 formed laterally throughout its overall length so that the front edge of fixed blade 3*a* is positioned higher than the central portion 59 thereof and the rear end of fixed blade 3*a* has a rear portion 60 which is also higher than than the central portion 59 and parallel thereto.

Movable blade 3*b*, on the other hand, is provided at its front end with a saw-toothed edge comprising a plurality of substantially triangular small teeth 61 arranged laterally side by side. Movable blade 3*b* also has at the front and rear ends stepped portions 62 extending throughout its overall length so that the front edge of blade 3*b* is positioned lower than its central portion 63 and the rear of blade 3*b* has a rear portion 64 also positioned lower than the central portion 63 and parallel thereto.

The fixed blade 3*a* and movable blade 3*b* are each provided with a plurality of flue removing bores 65, while the leaf spring 54 also is provided with flue removing bores 66. The fixed blade 3*a* and movable blade 3*b* are so disposed that their front edges contact with each other and the rear portions 60 and 64 also contact with each other, thereby forming a gap 67 between the central portion 59 of the fixed blade 3*a* and the central portion 63 of the movable blade 3*b*. Gap 67, clearly shown in FIG. 8, reduces a contact area between the fixed blade 3*a* and the movable blade 3*b* so that when the latter moves in lateral reciprocation, a frictional force acting on and between the fixed blade 3*a* and movable blade 3*b* is reduced.

The shaving blade 3, which is formed by the mating cooperation of the fixed blade 3*a* and the movable blade 3*b*, is fixed to the blade holder 32 and projects at its front edge from between a cutout 68 in front of blade holder 32 in blade support 34. The front end b of comb 6, the edge a of shaving blade 3, and the front end of blade edge cover 9, as shown in FIG. 7, are all curved forwardly in about equal curvatures and arranged substantially on a straight line in the plane perpendicular to the edge a of shaving blade 3 (FIG. 11). As a result, the comb 6, when the edge of shaving blade 3 is horizontal, projects foremost at its utmost end and the respective adjacent combing teeth 5 at comb 6 are spaced by an interval which is larger than that existing between the respective small teeth 4 at the fixed blade 3*a*.

Figure 9:
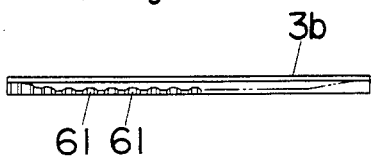
FIG. 9 is a front view of a movable blade used in the head.

The movable blade 3*b*, as shown in FIG. 9, becomes gradually thinner in the direction from both lengthwise ends to its center. As a result, as shown in FIG. 10, both ends of blade edge a may be press-contacted with relative intensity with a user's skin 7 while minimizing injury because the edge of the movable blade 3*b* is larger in thickness. On the other hand, the central portion of blade edge a is smaller in thickness and press-contacts with the skin with less intensity in comparison to the ends of the blade so as not to cut into the skin, as shown in FIG. 11, while still enabling the shaver to shave hairs 7 short.

Figure 12:
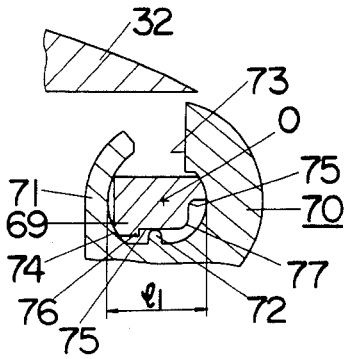
FIGS. 12 (*a*), (*b*) and (*c*) are views of a shaft and a bearing portion used in the FIG. 1 embodiment.
Figure 12:
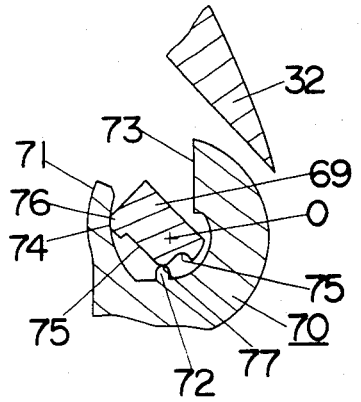
Figure 12:
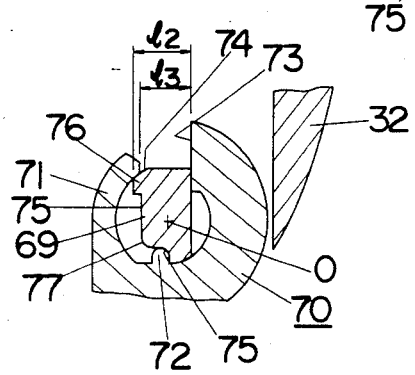
Figure 13:
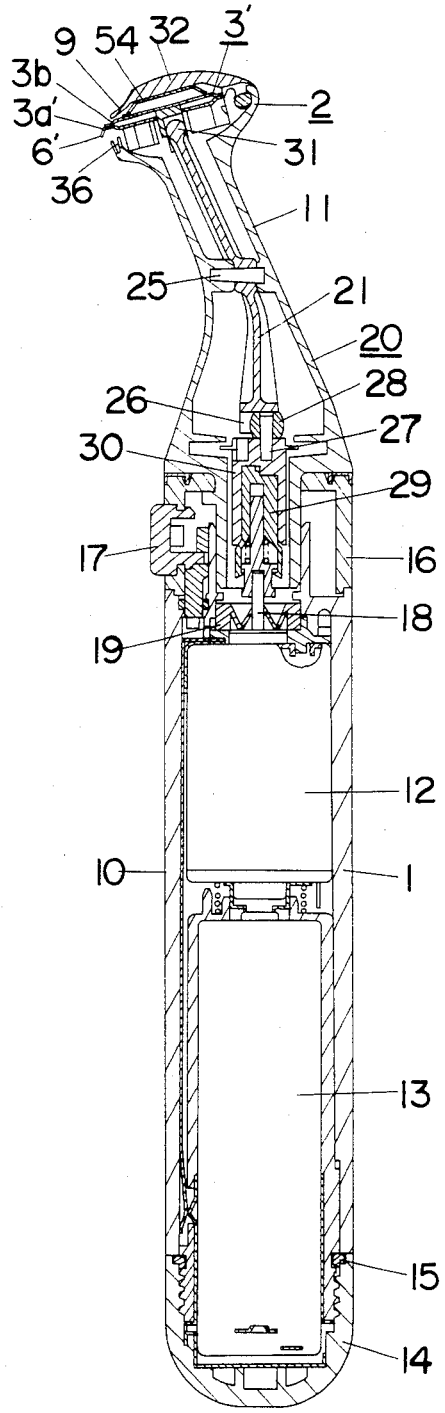
FIG. 13 is a view similar to FIG. 2, but showing a modified embodiment of the invention.
Figure 14:
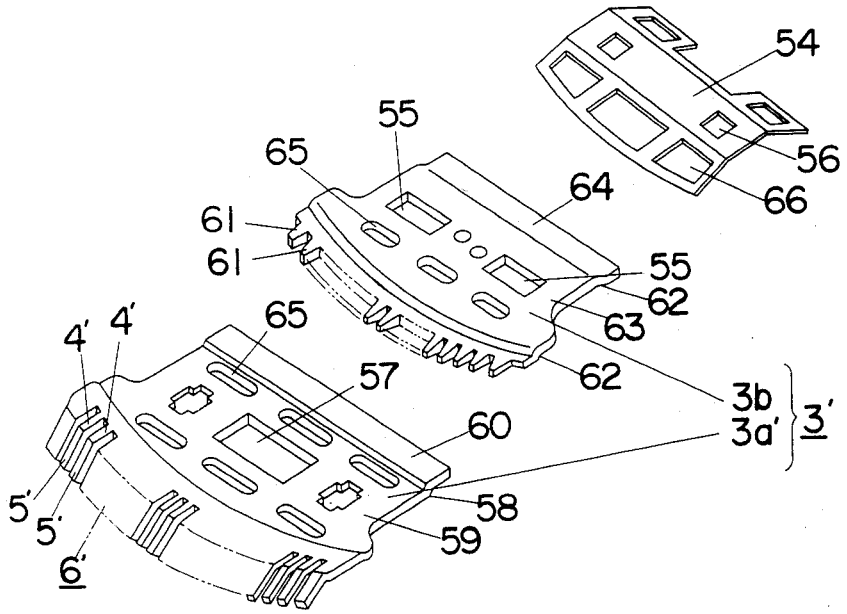
FIG. 14 is a perspective view of a portion of the embodiment shown in FIG. 13.
Figure 15:
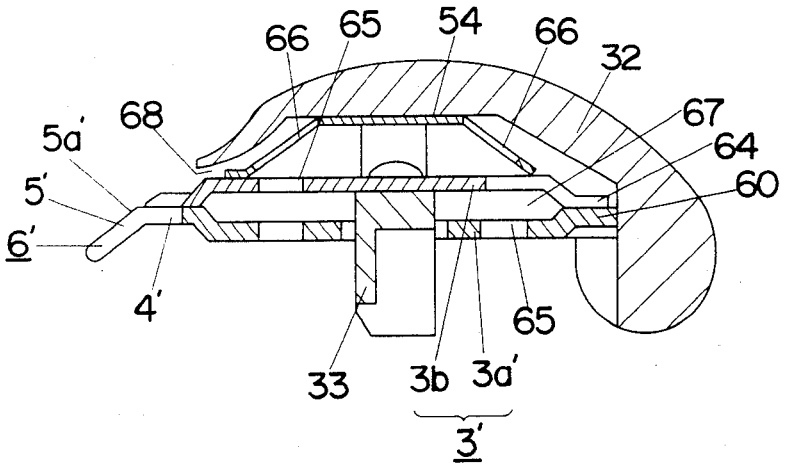
FIG. 15 is a view similar to FIG. 8, but showing the modified embodiment of the invention; and, FIG. 16 is a partial sectional view of the head of the modified embodiment during use.

Blade holder 32, as shown in FIGS. 5 and 6, is pivoted to the blade support 34 to permit a free opening or closing of the blade holder 32 through its shaft 69 which is provided at its rear. Shaft 69 extends laterally of blade holder 32 and is fitted into a bearing portion 70 at the rear end of blade support 34, the bearing portion having at both ends C-like portions 71 each having an elliptic shape in section, a major axis extending horizontally, and opening upwardly. Each C-like portion 71, as shown in FIG. 12, is smaller in thickness at the front wall and larger in thickness at the rear wall, the front wall being flexible. In addition, each C-like portion 71 has at the bottom a projection 72 and at the opening end face of its rear wall a stopper face 73 extending vertically. The stopper face 73 together with the projection 72 control the opening angle of blade holder 32. The shaft 69 and the blade holder 32, when the blade holder 32 closes, is kept so that its long side of the rectangular section is directed forwardly and backwardly of head 2. Shaft 69 is also cut at the front and lower corner to form a cut face 74, and is curved at its rear upper corner to conform to the inner periphery of the rear wall at the C-like portion 71. Shaft 69 is also provided at its rear and lower portion with a recess 75 opening downwardly and rearwardly and at the front of its lower surface with a projection at 76. It also has a snap face formed in a circular arc in section at the corner between one side of recess 75 and its lower surface. When the blade holder 32 is closed, the shaft 69 is as shown in FIG. 12(*a*) wherein shaft 69 rests completely within the C-like portion 71. On the other hand, when the blade holder 32 is fully opened, the shaft 69 moves to the position shown in FIG. 12(*c*) and is kept in this condition wherein recess 75 at the shaft 69 engages with the projection 72 at the bottom of C-like portion 71. In this position shaft 69 abuts at its one surface against the stopper face 73 at the C-like portion 71 so that the blade holder 32 is kept open at about a right angle with respect to the blade support 34.

A distance between the axis O of rotation of shaft 69 and the cut corner 74 is made somewhat larger than a distance between the axis O and the upper portion of the front wall at the C-like portion 71 so that the cut corner 74, as shown in FIG. 12(*b*), pushes the front wall of C-like portion 71 to deflect it forwardly resulting in the biasing of shaft 69 rearwardly. In this state, the snap face 77, when the shaft 69 rotates, rides over the projection 72 with the C-like portion 71 so as to exhibit a snap operation duing the rotation of shaft 69 between the closing position and the opening position of blade holder 32. In other words, the shaft 69, at the position where the blade holder 32 is opened, is subject to a force acting clockwise in FIG. 12 by means of the elastic force acting from the front wall of the C-like portion 71, thereby biasing and keeping the blade holder 32 in its fully open position.

As also shown in FIGS. 12(*a*) and (*c*), a width $l_3$ of the upper opening of the C-like portion 71 is made somewhat smaller than a width $l_2$ between the utmost end of projection 76 and the surface of shaft 69 opposite thereto. As a result, blade holder 32 when it is fully opened is pulled upwardly to deflect the front wall of C-like portion 71 thereby enabling shaft 69 to be taken out of C-like portion 71 and providing for removal of the blade holder 32 from the blade support 34. In addition, if an engaging dimension of the C-like portion 71 when the blade holder 32 is closed is represented by $l_1$, the relation $l_1>l_2>l_3$ exists, as shown in the drawing. However this relationship may also be $l_1>l_2=l_3$ or $l_1>l_3>l_2$.

The hinge coupling of blade holder 32 with blade support 34 by the use of shaft 69 and bearing portion 70 avoids damage to the edge of shaving blade 3 or its loss when blade holder 32 is dropped. Since the shaft 69 is fitted into the C-like portion 71 enabling a detachable mounting of the blade holder 32 to the blade support 34, the shaver of the invention is easily assembled and the blade holder 32 is easily removed from the blade support 34 which facilitates cleaning of minute portions of the shaver head, such as the bearing portion 70.

The operation of the shaver thus far described during use will now be described.

In use, the movable blade 3*b* is reciprocated along the edge of shaving blade 3 as the shaver is applied to the skin 8 for shaving, as shown in FIGS. 10 and 11. Since the front end b of comb 6, the edge a of shaving blade 3, and the front of edge cover 9, are arranged substantially on a straight line A—A′ (FIG. 11) in the plane which cuts and is perpendicular to the edge a of the shaving blade 3, the front end b of comb 6, and the front of edge cover 9, they contact simultaneously with skin 8. Also, they are curved forwardly in a circular arc at about equal curvatures and the blade holder 32 is convex at its upper surface, so that the shaver can contact close to a recessed portion, such as an underarm, with a smooth touch. In this state, when the shaver is moved in the direction from the front of edge cover 9 to the comb 6 along the skin 8, the skin is pulled by the comb 6 to raise hairs 7 so that the shaving blade 3 can easily catch them. The front end b of comb 6 and the front end of the edge cover 9 regulate the angle of shaving blade 3 which is in contact with skin 8 so that the shaving blade 3 contacts at a most suitable angle for shaving. Consequently, hairs 7 are easily and neatly removed during shaving and the skin 8 is not injured. Recess 49 at the upper surface of edge cover 9 allows the shaver to slide smoothly on the skin 8. Since the interval between the respective adjacent combing teeth 5 at the comb 6 is larger than that between the adjacent teeth 4 at the fixing blade 3*a*, the comb 6 roughly combs hairs 7 and, thereafter, the fixed blade 3*a* can minutely comb the hairs 7 to facilitate catching of the hairs by the shaving blade 3, thereby making it possible to shave them quickly and completely.

Since the shaver is encased in the case body 10 and the motor 12 and cell 13 are kept watertight by the use of O-ring 15 and waterproof panel 19, shaving can be accompanied by the use of a shaving soap or shaving foam, or, alternatively, shaving can be effective without these aids. The flue sink 36 is provided between the comb 6 and partition 35 so that when soap or shaving cream are used, the soap or flue 78 is substantially blocked by the partition 35 from entering into the head 2. As a result, the driving lever 21 or pivot pin 25 does not become saturated with attached soap or flue, enabling the driving lever 21 to have an umimpeded movement.

Since the movable blade 3*b* is disposed between the fixed blade 3*a* and the edge cover 9, and the fixed blade 3*a* and movable blade 3*b* project ahead of the edge cover 9 to allow their edges to slidably contact with each other, a large contact area between the movable blade 3*b* and skin 8 is created so that soap or shaving foam adhering to the skin 8 is introduced by the movable blade to form a thin film between the edges of the fixed blade 3*a* and movable blade 3*b* thereby reducing frictional resistance between the two blades and the load applied to motor 12. Accordingly, the shaver of the invention has an advantageous lifespan for battery 13 and, in addition, movable blade 3*b* moves smoothly to improve the cutting force and therefor operation of the shaver.

Figure 8:
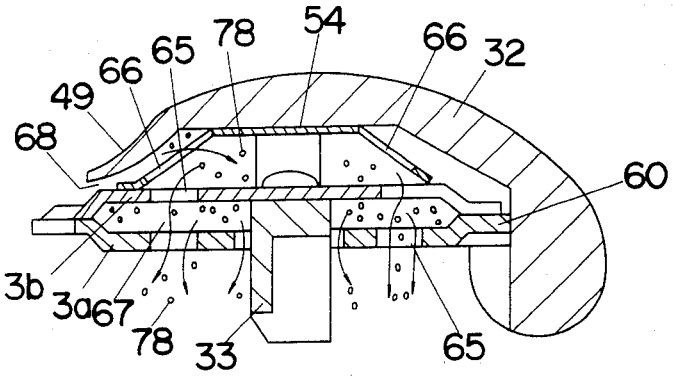
FIG. 8 is a partially sectional view of a movable blade used in the head.

To clean out any flue 78 which has collected in the head 2 after use of the shaver, the blade holder 32 may be opened or removed from the blade support 34 so that the head 2 can be washed. Because the head is waterproof, such washing does not impair its long-term durability. That is, the flue 78 or soap remaining at head 2, as shown in FIG. 8, is washed out through the flue removing bores 65 or 66 together with water used for washing the head 2. In addition, the head 2 can be operated such that the movable blade 3*b* is driven when the head 2 is immersed in water, thereby enabling a better cleaning thereof, and facilitating cleaning of the shaver whether the head 2 is open or closed.

As described above, in the shaver of the invention, the front end of the edge cover 9 arranged above the shaving blade, the front edge a of the shaving blade 3, and the utmost end b of a comb 6 disposed below the shaving blade, are arranged substantially on a straight line A—A′ (FIG. 11) in a plane perpendicular to the edge of the shaving blade, whereby the comb pulls the skin to raise hairs allowing the shaving blade to catch and cut them with ease, while the comb and edge cover keep the shaving blade in a constant preferred angle of contact with the skin thus providing optimal shaving conditions. As a result, the shaver can perform both a rough and fine finishing shaving without skin injury. Since the edge of the movable blade is positioned between the edge of the fixed blade and the edge cover, the edge of the fixed blade and edge cover regulate an angle of the edge in contact with the skin to there provide a safe shaving operation. Also, when soap or shaving foam is used for shaving, the contact area of the movable blade and the skin becomes larger and a film is formed between the edges of the fixed and removable blades which reduces frictional resistance between them as well as a load applied to the motor, thus prolonging the electric lifespan of the shaver while improving its cutting force. Furthermore, by providing an interval between the respective adjacent small teeth of the fixed blade which is smaller than the interval between the respective adjacent teeth of the comb, it is possible to have a rough combing of the hairs by the comb 6 and thereafter a minute combing of the hairs by the fixed blade 3*a* thereby facilitating guidance of the hairs into the shaving blade and permitting a finishing shaving operation without leaving unshaved hairs. Additionally, since the front end of the edge cover, the edge of the shaving blade, and the utmost end of the comb, are curved forwardly in a circular arc which swells at its center and with equal curvature, the shaving blade can be brought into contact with the skin close to a body recess such as an underarm, while the contact area between the shaving blade and skin can be increased, which leads to a quicker shaving operation. In addition, the smoothly curved recess formed on the upper surface of the edge cover, one end of which faces the front end of the edge cover, enables the shaver to slide smoothly and easily on the skin, thus further facilitating a shaving operation.

A modified embodiment of the invention is illustrated in FIGS. 13–16. In this modified embodiment, parts having the same function and operation as parts illustrated in the previous embodiment are shown with like reference numbers. Modified parts are shown with a prime "′" next to the reference number.

In the modified embodiment, the front edge of a fixed blade 3*a*′ is bent in a chevron shape and its horizontal portion is formed as a comb-shaped edge comprising a number of small teeth 4′ which are arranged laterally side by side. A sloped portion of fixed blade 3*a*′ is formed in a comb 6′, the comb 6′ comprising combing teeth 5′ projecting slantwise downwardly and forwardly from the small teeth 4′ and arranged side by side respectively, thereby enabling a smooth vertical movement of the shaver and preventing it from laterally sliding.

Since the combing teeth which project slantwise forwardly and downwardly from the respective small teeth 4′ at the edge of the fixed blade 3*a*′ are integral therewith, each groove between the adjacent combing teeth is formed in continuation of each groove between the small teeth 4′ at the fixed blade 3*a*′ so that hairs once guided into the comb can be guided reliably to the fixed blade where they are cut. Also, because the edge of the fixed blade is integral with the comb and not shifted with respect thereto, the edge of the fixed blade 3*a*′ will not accidentally project or retreat relative to the angle of the head as the angle depends solely upon a straight line connecting the comb and edge cover. Accordingly, the shaver of this embodiment is advantageous in that the blade achieves reliable contact with the skin on the basis of the fixed blade and edge cover 9 only, which naturally positions the edge of the movable blade.

Figure 16:
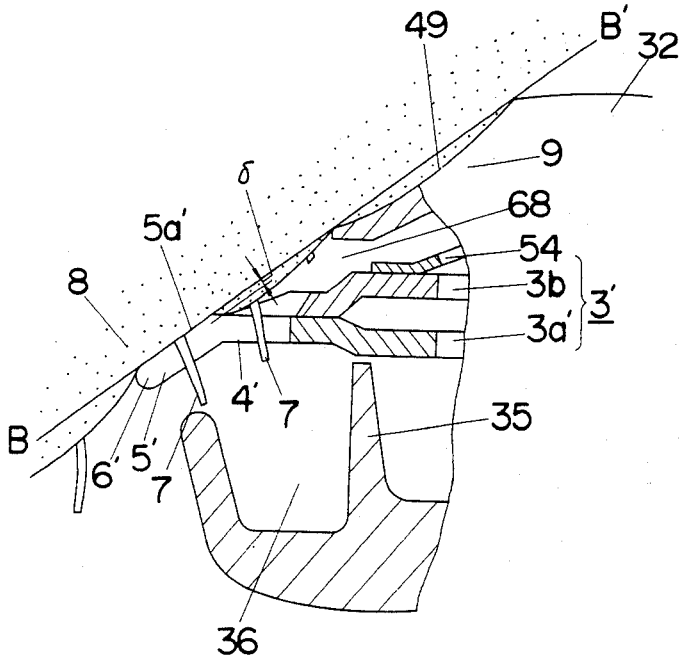

As in the first embodiment, the front edge of edge cover 9 and the front end of comb 6′ are aligned on a straight line B—B′ (FIG. 16) in a plane perpendicular to and cutting the front end of the edge cover 9, the front edge of the shaving blade 3′ and the front end of comb 6′. The front shaving edge of shaving blade 3 is slightly offset below this straight line by a small value δ (FIG. 16).

Although two representative embodiments of the invention have been shown and described, it should be appreciated that many modifications can be made to these embodiments without departing from the spirit and scope of the invention. Accordingly, the invention is not limited by the foregoing desciption, but is only limited by the claims which are appended hereto.

What is claimed is:

1. An electric shaver comprising:

a housing;

a shaving head projecting from an upper end of said housing;

a shaving blade having a front shaving edge extending laterally along a front end of said head, said front edge of said shaving blade projecting from said front end of said head, said shaving blade comprising a fixed blade which has at a front end thereof a comb-shaped edge comprising a number of small teeth arranged laterally side by side and which is fixed in a predetermined position at said head, and a movable blade which has a comb-shaped edge in slidable contact with said comb-shaped edge of said fixed blade and which is movable in reciprocation laterally of said head;

a comb having a number of combing teeth arranged laterally side by side and positioned below said front shaving edge of said shaving blade;

an edge cover provided above said shaving blade for abutting against skin when said shaver is in use to regulate, together with said comb, an angle which the edge of said shaving blade makes with respect to said skin; and a front edge of said edge cover, and a front end of said comb being aligned on a straight line in a plane perpendicular to and cutting said front edge of said edge cover, said front shaving edge of said shaving blade and said front end of said comb.

2. An electric shaver according to claim 1, wherein said front shaving edge of said shaving blade is substantially aligned on said straight line.

3. An electric shaver according to claim 1, wherein said front shaving edge of said shaving blade is located below and slightly offset from said straight line.

4. An electric shaver according to claim 2, wherein said comb-shaped edge of said movable blade is positioned between said comb-shaped edge of said fixed blade and said edge cover.

5. An electric shaver according to claim 3, wherein said comb-shaped edge of said movable blade is positioned between said comb-shaped edge of said fixed blade and said edge cover.

6. An electric shaver according to claim 2, wherein an interval between respective adjacent teeth at said fixed blade is smaller than an interval between the respective adjacent combing teeth at said comb.

7. An electric shaver according to claim 2, wherein said front edge of said edge cover, said front edge of said shaving blade, and said front end of said comb are each curved forwardly in a circular arc and have a swelled central portion.

8. An electric shaver according to claim 3, wherein said front edge of said edge cover, said front edge of said shaving blade, and said front end of said comb are each curved forwardly in a circular arc and have a swelled central portion.

9. An electric shaver according to claim 2 further comprising a recess, formed above and in said edge cover and extending throughout an approximately longitudinally overall length of a front end of said edge cover, said recess opening upwardly in a plane which is perpendicular to the front edge of said shaving blade and facing at one end thereof said front edge of said edge cover.

10. An electric shaver according to claim 3 further comprising a recess, formed above and in said edge cover and extending throughout an approximately longitudinally overall length of a front end of said edge cover, said recess opening upwardly in a plane which is perpendicular to the front edge of said shaving blade and facing at one end thereof said front edge of said edge cover.

11. An electric shaver according to claim 2, wherein said comb is spaced from and is located below said shaving blade.

12. An electric shaver according to claim 3, wherein said comb is integrally connected to said shaving blade and extends forwardly and downwardly therefrom.

* * * * *